US009127828B2

(12) United States Patent
Zhang et al.

(10) Patent No.: US 9,127,828 B2
(45) Date of Patent: Sep. 8, 2015

(54) LAMP WITH UNIFORM ILLUMINATION PATTERN

(71) Applicant: Wanjiong Lin, Ningbo (CN)

(72) Inventors: Fawei Zhang, Ningbo (CN); Taolin Zhu, Ningbo (CN); Dingyi Wang, Ningbo (CN)

(73) Assignee: Self Electronics Co., Ltd., Ningbo (CN)

( * ) Notice: Subject to any disclaimer, the term of this patent is extended or adjusted under 35 U.S.C. 154(b) by 127 days.

(21) Appl. No.: 13/934,756

(22) Filed: Jul. 3, 2013

(65) Prior Publication Data

US 2014/0119001 A1 May 1, 2014

(51) Int. Cl.

| | |
|---|---|
| ***F21V 21/00*** | (2006.01) |
| ***F21V 5/04*** | (2006.01) |
| ***F21K 99/00*** | (2010.01) |
| *F21Y 101/02* | (2006.01) |
| *F21Y 113/00* | (2006.01) |

(52) U.S. Cl.

CPC ... *F21V 5/04* (2013.01); *F21K 9/17* (2013.01); *F21K 9/50* (2013.01); *F21Y 2101/02* (2013.01); *F21Y 2113/00* (2013.01)

(58) Field of Classification Search

CPC ..... F21K 9/17; F21K 9/50; F21K 99/00; F21S 2/005; F21S 2/00; F21Y 2113/00

USPC ..... 362/225, 227, 228, 230, 231, 249.06, 362/249.13, 255

See application file for complete search history.

(56) References Cited

U.S. PATENT DOCUMENTS 3,372,272 A * 3/1968 Horley et al. ..... 362/225
2012/0106163 A1* 5/2012 Liang ..... 362/296.01

FOREIGN PATENT DOCUMENTS

WO WO 2011086176 A1 * 7/2011

* cited by examiner

*Primary Examiner* — Y M Lee

(74) *Attorney, Agent, or Firm* — Wang Law Firm, Inc.; Li K. Wang; Stephen Hsu

(57) ABSTRACT

A lamp with uniform illumination pattern is used for continually illuminating an illuminated area and includes at least one light module. The at least one light module includes two light sources respectively having different light intensity and arranged orderly. Two extension lines of two optical axes of the two light sources have one crossover point. Light emitted from the light source with less light intensity illuminates the illuminated area which is closer to the light module, while light emitted from the light source with greater light intensity illuminates the illuminated area which is farther to the light module. Light emitted from the light source, which is father to the illuminated are, can make up the intensity losses of attenuation since light emitted from the light source which is father to the illuminated area have greater light intensity. As a result, the lamp has uniform illumination pattern.

18 Claims, 4 Drawing Sheets

LAMP WITH UNIFORM ILLUMINATION PATTERN

CROSS-REFERENCE TO RELATED ART

This application claims the benefit of priority to CN201210441421.9, filed with the State Intellectual Property Office of the People's Republic of China on Oct. 28, 2012, the specification of which is incorporated herein in its entirety by reference.

BACKGROUND

1. Technical Field

The disclosure relates to electrical lighting devices, and more particularly to a lamp using at least one single-chip or multi-chip light-emitting-diode ("LED"), and creating a highly uniform illumination pattern.

2. Description of the Related Art

For years, people have used traditional incandescent or fluorescence lighting apparatus in order to address their interior lighting concerns. However, such lighting apparatus presents a number of drawbacks. For example, the popular halogen apparatus presents the following drawbacks, such as relatively high power consumption, inefficiency of light dispersion due to the placement of its metal shield in the line sight of the halogen bulb, and its limited effectiveness in preventing glare from the halogen bulb.

Recently, a number of LED lighting apparatuses have been designed to replace the halogen apparatus, as well as other traditional incandescent or fluorescence lighting apparatuses. But, due to mediocre light output, LED use in the past was primarily limited to applications where only small surface areas were illuminated. In these applications the light was concentrated into a narrow beam using an optic designed to take the wide angle light output of an LED and collimate it using a lens, discussed below with respect to FIG. 1. FIG. 1 shows a traditional light illumination system. The light illumination system includes an illuminated area 1, and a LED light module 2 positioned beside the illuminated area 1. The LED light module 2 has a light emitting surface 3 and light 4 emitted forward of the light emitting surface 3 and illuminating the illuminated area 1. Understandably, regardless of where the LED light module is disposed with relationship of the illuminated area 1, part of the light 4 illuminates the illuminated area 1 which is closer to the LED light module 2 and the other illuminates the illuminated area 1 which is farther to the LED light module 2. Since the performance of the above illumination is inevitable, part of the light 4, which illuminates the illuminate area 1 and is farther to the LED light module 2, has more attenuation than the other which illuminates the illuminate area 1 and is closer to the LED light module 2. However, the light 4 emitted from the light emitting surface 3 has same initial light intensity. As a result, the illumination value of the illuminated area 2 varies with the distance between the illumination area 1 and the LED light module 2. Examples of some applications of the light illumination system include exhibition hall, showcase, and so on. These new applications require different optical designs. In particular these applications require uniform illumination in the illumination area 2 for improving the sense of quality of the showed products to people.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout two views.

DETAILED DESCRIPTION

The disclosure is illustrated by way of example and not by way of limitation in the figures of the accompanying drawings. It should be noted that references to "an" or "one" embodiment in this disclosure are not necessarily to the same embodiment, and such references mean at least one.

Figure 1:
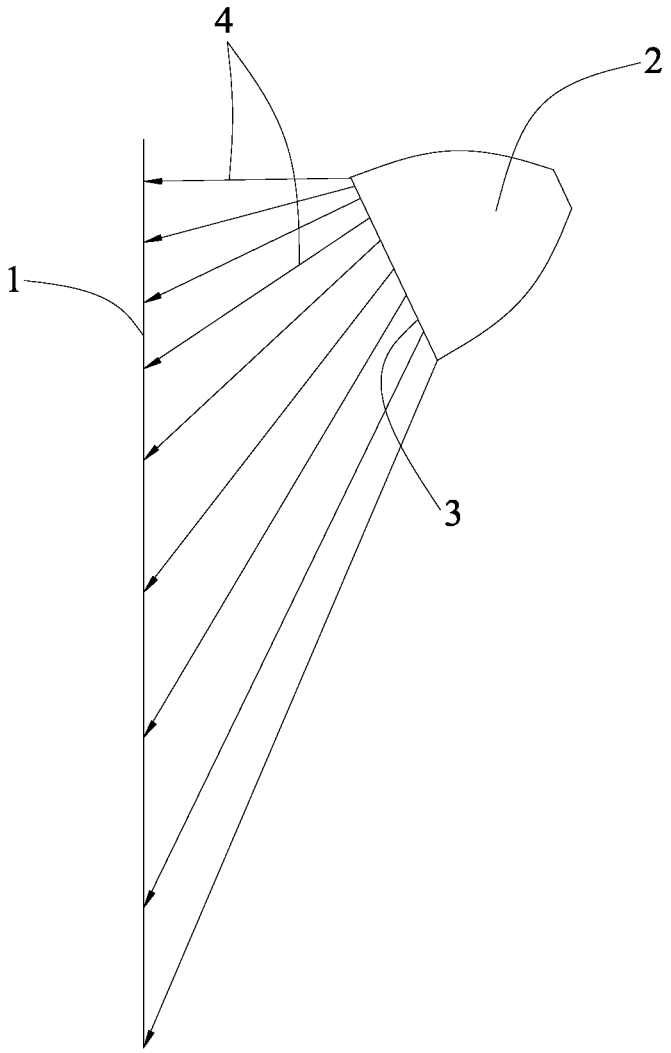
PRIOR ART FIG. 1
FIG. 1 is a light path view of a light illumination system in the prior art.

Referring to FIG. 1, an isometric exploded view of a lamp 100 with uniform illumination pattern according to an embodiment is shown. The lamp 100 includes a base 10, a transparent cover 11 clamped to the base 10, at least a light module 12 disposed on the base 10, at least a lens module 13 mounted on the light module 12, two end caps 14 respectively disposed on two end of the base 10, and two fits 15 respectively disposed on outer side of the two end caps 14.

The base 10 may be made of metal material. In the present embodiment, the base 10 is made of aluminum and is contributed to heat dissipation while the light module 12 generates much heat during work. The base 10 has a U shape or U-liked shape and is integrately molded. The base 10 includes at least a light module location 101, and two clamping edges 102 extended from two sides of the base 10. The light module location 101 is arranged between two sides of the base 10 like a bridge and used to mount the light module 12. Since the light module 12 may have much, the light module location 101 should have same quantity with the light module 12 accordingly.

The transparent cover 11 may be made of transparent material, such as glass, transparent resin, and so on. The transparent cover 11 may have a U shaped or U-like shape for forming a receiver to receive the light module 12 and includes two clamping grooves 111 disposed two side thereof. For making the receiver, the transparent cover 11 is set on the base 10 oppositely. As a result, the transparent cover 11 is mounted on outside of the light module 12. Length of the base 10 and the transparent cover 11, and location of the two clamping grooves 111 may be designed with the volume of the receiver to receive the light module 12.

Figure 2:
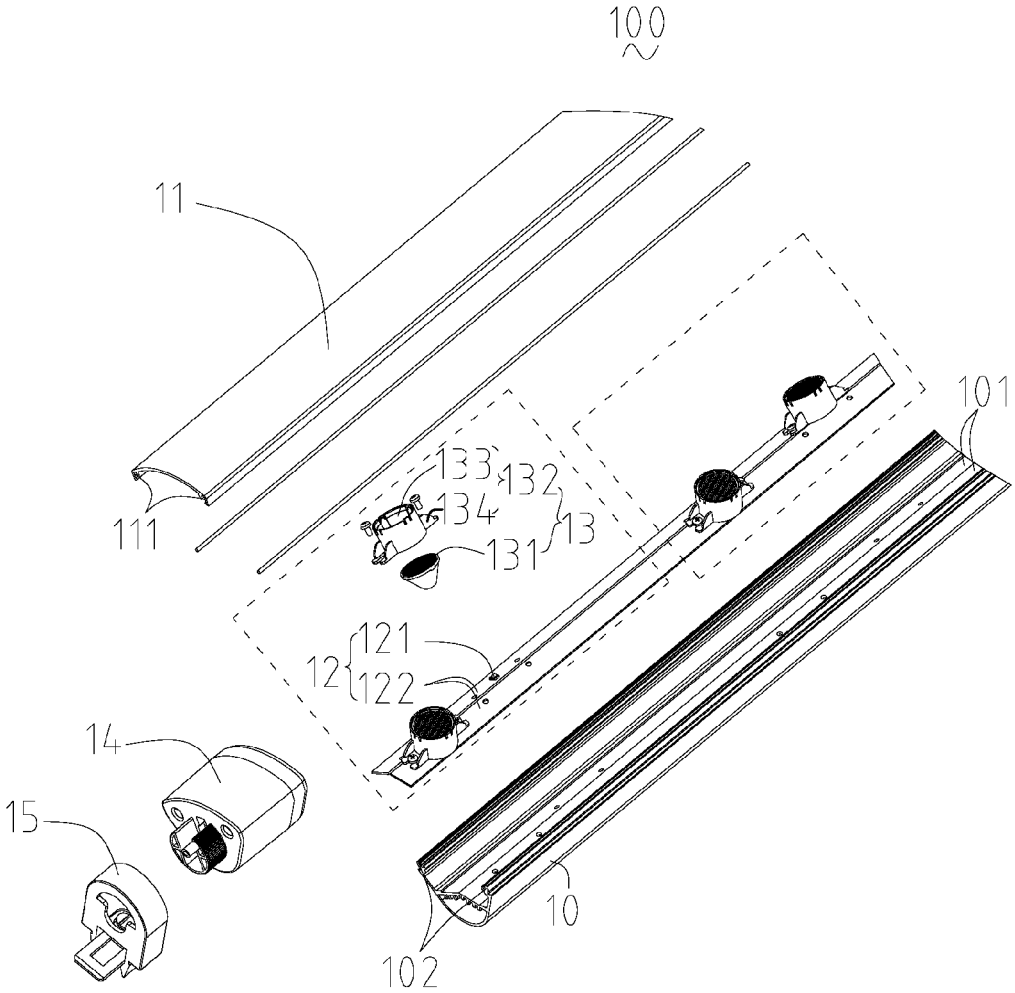
FIG. 2 is an exploded view of a lamp with uniform illumination pattern in accordance with one embodiment of the disclosure.
Figure 3:
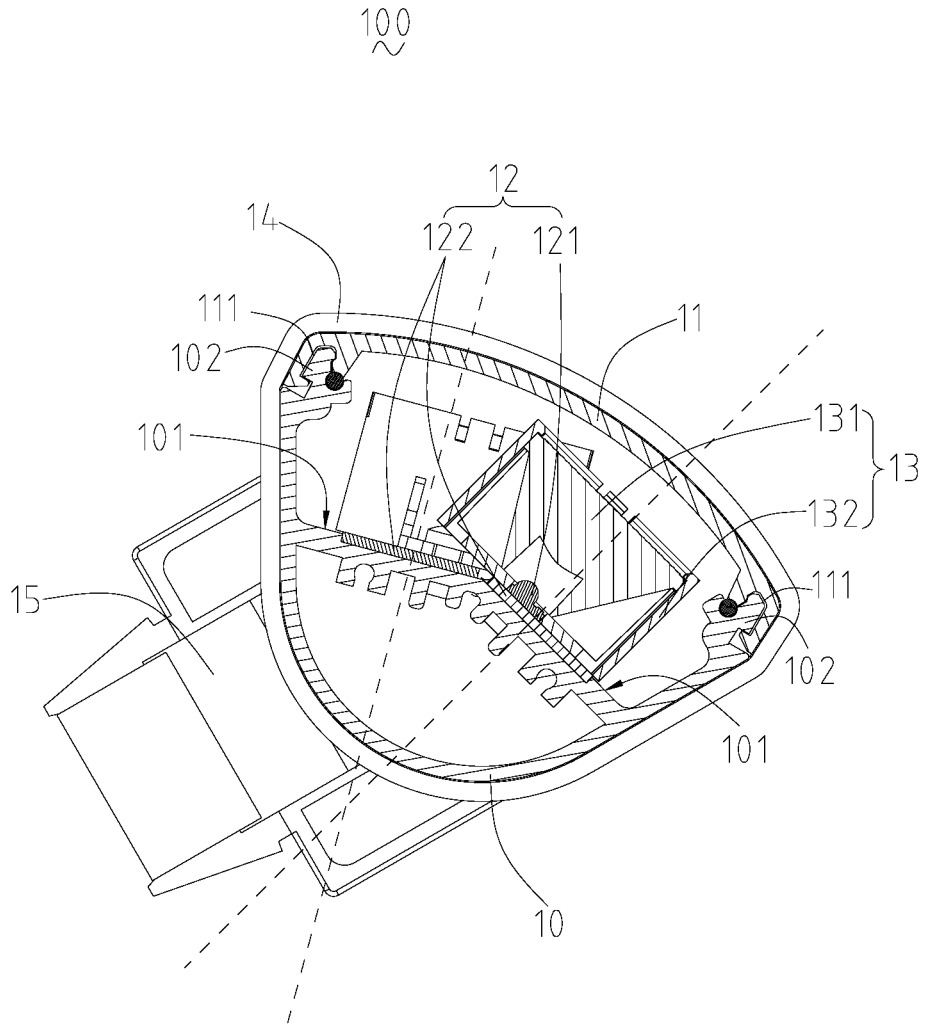
FIG. 3 is a section view of the lamp with uniform illumination pattern of FIG. 1.

The light module 12 includes at least two sets of light sources 121, and at least two PCBs (Printed Circuit Board) 122 for mounting the light sources 121. The light sources 121 can be LEDs, or some traditional lamp, such as incandescent lighting. In the present embodiment, the light sources 121 are LEDs. The at least two sets of light sources 121 have different light intensity, that is to say, one has stronger light intensity than the other. Understandably, the light module 12 includes many sets of light sources 121, such as three or four. As shown in FIG. 2, each of dot boxes stands for one light module 12. In the present embodiment, each of the light modules 12 has two sets of light sources 121 shown in FIG. 2. When the light module 12 includes many light sources 121, length in radial direction of the lamp 100 may have greater value than that shown in FIG. 2. Moreover, when the light module 12 includes many sets of light sources 121, the light sources 121 must be arranged in order of light intensity and must not be arranged at random. Two extension lines of two optical axes of any two sets of light sources 121 have one crossover point, as shown in FIG. 3. As a result, the at least two sets of light sources 121 illuminate different position of an illuminated area. The lamp 100 may have strip shape, the at least two sets of light sources 121 of the light module 12 should be arranged along the radial direction of the lamp 100 or the base 10. As the lamp 100 may include a plurality of light modules 12, the plurality of light modules 12 may be arranged on the base 10 along circumference axial direction of the lamp 100. In one light module 12, the at least two light sources 121 are arranged in accordance with light distribution, such as shoulder by shoulder or in staggered form. When the at least two light sources 121 are arranged shoulder by shoulder, the connecting line between two optical axes of any two light sources 121 is perpendicular to the circumference axis of the lamp 100. When the at least two light sources 121 are arranged in staggered form, the connecting line between two optical axes of any two light sources 121 has an acute angle or an obtuse angle with the circumference axis of the lamp 100. In the present embodiment, the at least two light sources 121 are arranged in staggered form. Moreover, for easy to manufacture, a plurality of light sources 121 which has same light intensity, are disposed on one PCB 122, which contribute to improve convenience, generality, and interchangeability in assembly and manufacture. The illumination pattern of the illumination area, which is formed by light emitted from forward of the light module 12, is continuous or overlapped partly. The PCBs 122 are well known by the people in the art and have some circuits and electronic components assembled thereon, such as diode, transistor, and so on, for providing rated current or control signal to the light sources 121.

As shown in FIG. 3, the lens module 13 includes at least a lens 131, and an assembling portion 132 for assembling the lens 131. The lens 131 may be a traditional lens, a special-shaped lens or a convex lens, and is selected therefrom in accordance with light distribution. In the present embodiment, the lens 131 is a traditional lens shown in FIG. 3, which is used in the prior art, and is well known by the people in the art. The assembling portion 132 includes a connection portion 133, and a supporting portion 134 disposed on the connection portion 133. The assembling portion 132 is integrated into the lens 131. The connection portion 133 is configured to dispose the supporting portion 134 and to connect a plurality of lens 131 into together for ease to assembly. The supporting portion 134 is configured to assemble the lens module 13 onto the PCB 122 of the light module 12.

The two end caps 14 are fixed on the two ends of the base 10 via some fasteners such as screws and are configured to form a closed receiver with the base 10 and the transparent cover 11 together for protecting the light module 12 and the lens module 13.

The fits 15 are configured for mounting the lamp 100 onto the illuminated area. Need to explain that drawings only show one end cap 14 and one fit 15 mounted on one end of the lamp 100 because of the limitation of paper.

Figure 4:
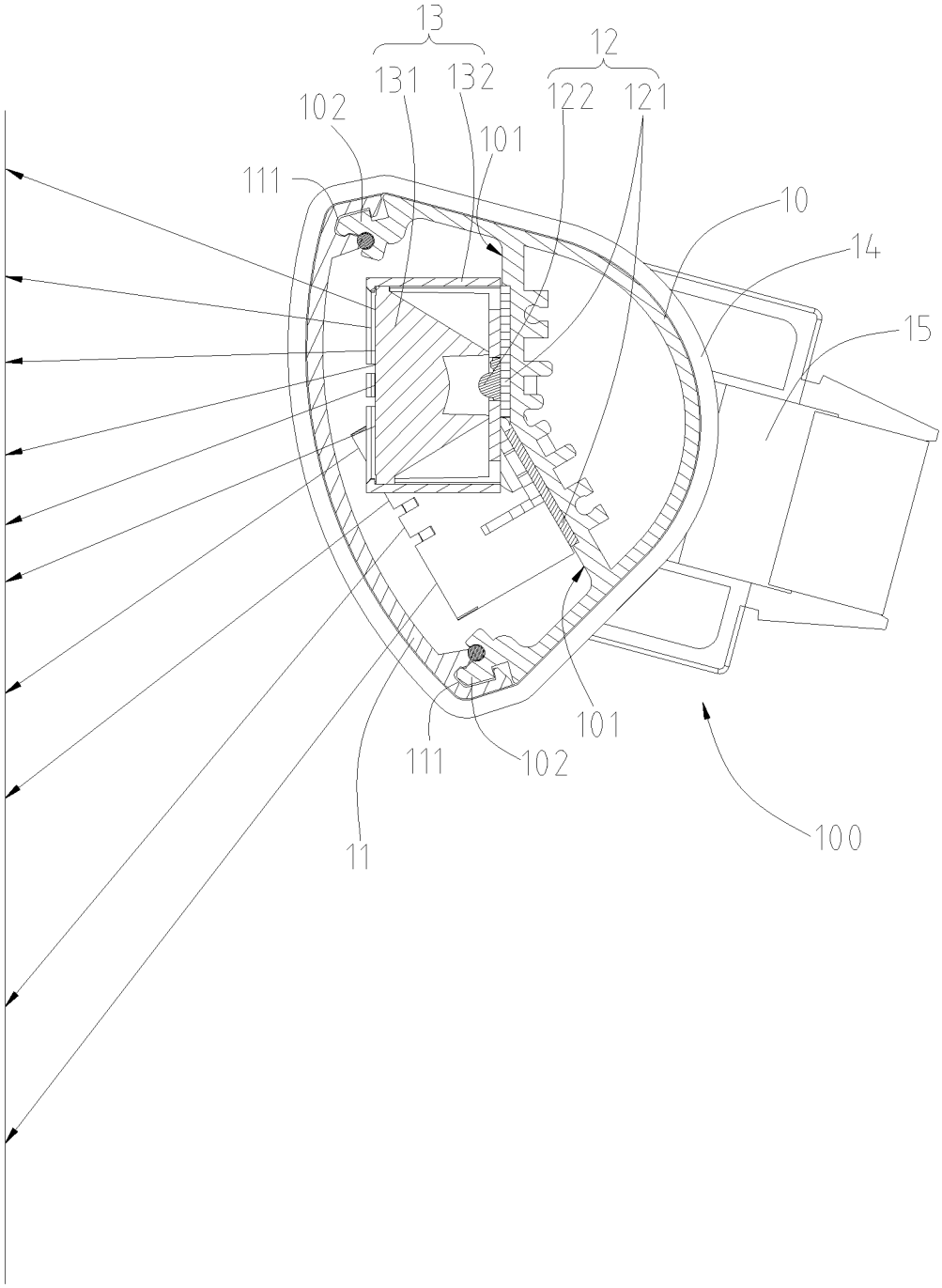
FIG. 4 is a light path view of the lamp with uniform illumination pattern of FIG. 1.

In use, as shown in FIG. 4, light emitted from the light source 121 with less light intensity must illuminate the illuminated area which is closer to the light module 12, while light emitted from the light source 121 with greater light intensity illuminate the illuminated area which is farther to the light module 12. Therefore, although the light emitted from the light source 121 with greater light intensity may have greater attenuation than the light emitted from the light source 121 with less light intensity as they illuminate the illuminated area which is farther to the light module 12, light emitted from the light source 121, which is father to the illuminated are, can make up the intensity losses of attenuation since light emitted from the light source 121 which is father to the illuminated area has greater light intensity. As a result, the illumination pattern which is closer to the light module 12 has same luminance with the illumination pattern which is father to the light module 12. That is to say, the lamp 100 have uniform illumination pattern. Understandably, the illuminated area along radial direction and circumference axis direction of the lamp 100 can be increased by assembling more light modules 12 on the lamp 100.

While the disclosure has been described by way of example and in terms of exemplary embodiment, it is to be understood that the disclosure is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A lamp with uniform illumination pattern and used for continually illuminating an illuminated area, the lamp comprising at least one light module, the at least one light module comprising at least two light sources respectively having different light intensity and arranged orderly, two extension lines of two optical axes of the two light sources having one crossover point, light emitted from the light source with less light intensity illuminating the illuminated area which is closer to the light module, while light emitted from the light source with greater light intensity illuminating the illuminated area which is farther to the light module.

2. The lamp of claim 1, wherein the light source comprises an LED.

3. The lamp of claim 1, wherein the lamp further comprises at least two lens modules respectively positioned in light path of the two light sources of the light module.

4. The lamp of claim 3, wherein the light module further comprises a circuit board, the light source is mounted on the circuit board.

5. The lamp of claim 3, wherein the lens module comprises a lens and an assembling portion for assembling the lens, the lens is disposed in light path of the light source.

6. The lamp of claim 1, wherein the lamp has a strip type, the two light sources are arranged along the radial direction of the lamp.

7. The lamp of claim 1, wherein the lamp has a strip type, the at least one light module is arranged along the circumference axis direction of the lamp.

8. The lamp of claim 1, wherein the light module further comprises at least one circuit board, the light source which has same light intensity is disposed on one circuit board.

9. The lamp of claim 1, wherein the two light sources of the light module are arranged shoulder by shoulder.

10. The lamp of claim 1, wherein the two light sources of the light module are arranged in staggered form.

11. A lamp with uniform illumination pattern and used for continually illuminating an illuminated area, the lamp comprising at least one light module, the at least one light module comprising two light sources respectively having different light intensity and arranged in staggered form, two extension lines of two optical axes of the two light sources having one crossover point, light emitted from the light source with less light intensity illuminating the illuminated area which is closer to the light module, while light emitted from the light source with greater light intensity illuminating the illuminated area which is farther to the light module.

12. The lamp of claim 11, wherein the lamp further comprises at least two lens modules respectively positioned in light path of the two light sources of the light module.

13. The lamp of claim 12, wherein the lens module comprises a lens and an assembling portion for assembling the lens, the lens is disposed in light path of the light source.

14. The lamp of claim 12, wherein the lens module comprises a lens and an assembling portion for assembling the lens, the lens is disposed in light path of the light source.

15. A lamp with uniform illumination pattern and used for continually illuminating an illuminated area, the lamp comprising at least one light module, the at least one light module comprising two light sources respectively having different light intensity and arranged shoulder by shoulder, two extension lines of two optical axes of the two light sources having one crossover point, light emitted from the light source with less light intensity illuminating the illuminated area which is closer to the light module, while light emitted from the light source with greater light intensity illuminating the illuminated area which is farther to the light module.

16. The lamp of claim 15, wherein the lamp further comprises at least two lens modules respectively positioned in light path of the two light sources of the light module.

17. The lamp of claim 16, wherein the lens module comprises a lens and an assembling portion for assembling the lens, the lens is disposed in light path of the light source.

18. The lamp of claim 16, wherein the lens module comprises a lens and an assembling portion for assembling the lens, the lens is disposed in light path of the light source.

* * * * *